United States Patent [19]

Biedenbach

[11] Patent Number: 4,945,959

[45] Date of Patent: Aug. 7, 1990

[54] DEVICE FOR PLANING AND MOLDING SURFACE TEXTURES IN WOOD BOARDS

[75] Inventor: Marita Biedenbach, Hunfeld, Fed. Rep. of Germany

[73] Assignee: Hubert Josef Koch, Fed. Rep. of Germany

[21] Appl. No.: 318,207

[22] Filed: Mar. 3, 1989

[30] Foreign Application Priority Data

Mar. 9, 1988 [DE] Fed. Rep. of Germany ..... 3807722
Jul. 26, 1988 [DE] Fed. Rep. of Germany ..... 3825340

[51] Int. Cl.[5] ..... B27C 5/00

[52] U.S. Cl. ..... 144/134 R; 144/2 R; 144/114 R; 144/130; 144/137; 144/359; 144/360; 144/361; 144/358

[58] Field of Search ..... 144/2 R, 3 R, 114 R, 144/117 R, 134 R, 136 R, 137, 130, 359, 360, 361, 358

[56] References Cited

U.S. PATENT DOCUMENTS

| | | | |
|---|---|---|---|
| 2,617,223 | 11/1952 | McElroy et al. | 144/361 |
| 3,299,922 | 1/1967 | Vonhof | 144/361 |
| 3,353,574 | 11/1967 | Kvalheim et al. | 144/2 R |
| 3,703,198 | 11/1972 | Luebs et al. | 144/2 R |
| 3,756,295 | 9/1973 | Halop | 144/2 R |
| 3,779,294 | 12/1973 | Gillis | 144/134 R |
| 4,060,112 | 11/1977 | Leeper, Jr. | 144/2 R |

*Primary Examiner*—W. Donald Bray
*Attorney, Agent, or Firm*—Lowe, Price, LeBlanc, Becker & Shur

[57] ABSTRACT

A device for planing and/or molding surface textures in wood boards is provided with two planing heads (44,46) arranged one behind the other, the movement of which can be selectively cycled both in the vertical direction and transversely to the feed direction of the wood boards to be planed, thus permitting production of a variety of surface textures in the wood boards being planed.

13 Claims, 4 Drawing Sheets

DEVICE FOR PLANING AND MOLDING SURFACE TEXTURES IN WOOD BOARDS

FIELD OF THE INVENTION

This invention relates to a device for planing and/or molding surface textures in wood boards.

BACKGROUND OF THE PRIOR ART

Particularly for decorative purposes it is often desired to texture the surface of wood boards in a regular or irregular pattern to endow the surface with, for instance, a rustic appearance. Such surface textures were formerly produced by a hand plane, i.e., or a machine plane molder was used to produce a consistent texture in the wood surface. However, using the hand plane is time-consuming and costly, and using the known machine plane has in particular the disadvantage that only one and the same pattern or contour texture is possible, particularly in the feed direction of the wood board.

SUMMARY OF THE INVENTION

The primary object of the present invention is thus to create a device for planing and/or molding surface textures in wood boards which permits machining a plurality of differing — particularly also of irregular-surface textures in wood boards whilst being relatively simple in design.

This object is achieved by the invention substantially comprising two planing heads which can be moved periodically with respect to the surface of the wood board being machined by being conveyed past said planing heads. In this arrangement the two planing heads can be moved parallel to the wood surface being machined, at right angles to the direction in which the boards are conveyed and/or substantially vertical to the wood surface being machined.

By suitably controlling the movement of the planing heads — particularly periodically or aperiodically — a plurality of surface textures can be produced. Thus, the planed patterns, graded according to the selected planing frequency (cycle) as dictated by the machine, can be reproduced substantially quicker, more rationally and more precisely than in manual production. In the case of the present invention a regular — or also an irregular — surface texture can be planed, depending on the parameters entered into the machine control assembly. The cycle time of planing is variable, i.e., the machining cycle can be individually adjusted both in the horizontal and vertical direction as well as in the feed direction.

The present invention can also be used for wood molding, this merely requiring the cutters of the planing heads to be changed and the vertical and/or horizontal positions of the heads to be fixed during feed of the wood boards. In this way, molded boards or rods can be produced rationally, quickly and cost effectively on a single machine which is also capable of machining additional irregular surface textures.

Each planing head could also be moved independently of the other. The planing heads/are preferably moved, together, with one head being substantially behind the other as viewed in the conveying direction of the wood boards; with the cutters being differently shaped, again as viewed in the conveying direction. The cutters can be wavy-shaped with a plurality of peaks and valleys in sequence, whereby the cutters of the front and rear planing head are arranged at an angle to the direction of movement of the wood boards so that two texture scallops — opposed at an angle to each other in the longitudinal and transverse direction of the board — can be produced during a certain planing cycle. The length of each scallop is given by the duration of each working cycle in conjunction with the feed rate of the wood board; the width of each scallop is given by the shape of the planing cutters in conjunction with the amount of vertical movement of the planing heads during a working cycle. By moving the planing heads at right angles to the direction of feed of the wood boards additional options are provided for varying the surface texture.

Freedom of movement of the planing heads is achieved in the preferred embodiment of the invention by mounting the planing heads on a slide element running transversely on a height-adjustable guide element. By means of suitable cylinder/piston assemblies the movement of the slide assembly in a plane vertical to the feed direction of the wood boards can be controlled in any direction via suitable control devices.

It is understood that the invention also comprehends a type of device in which the surface of the board to be machined is stationary and the planing heads are moved, for instance, by a suitable slide or carriage assembly, along the surface of the board to be machined. Preferably, however, the planing head arrangement — with the exception of the aforementioned possibilities of movement — is stationary and the device comprises a board mounting plate having an opening through which the planing heads can be brought into contact with the surface of the wood board being machined.

In a further preferred embodiment of the invention, the device includes an adjustable guide stop for the wood boards to permit varying the conveying direction of the wood boards relative to the planing heads. Simply adjusting the direction of the guide stop will produce, in turn, clearly differentiated surface textures in the wood surface being machined.

FIG. *7a* and *7b* are a front view and side view, respectively, of a cutter insert for the planing heads of the apparatus according to a preferred embodiment of the invention.

Figure 8:
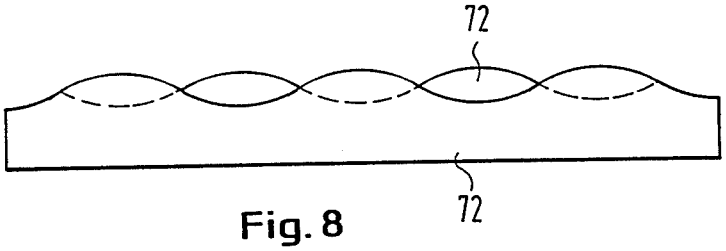
Figure 9:
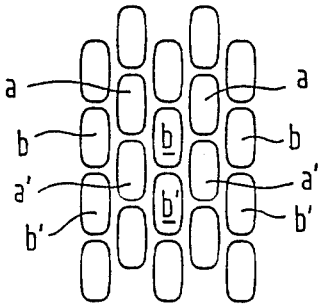
Figure 10:
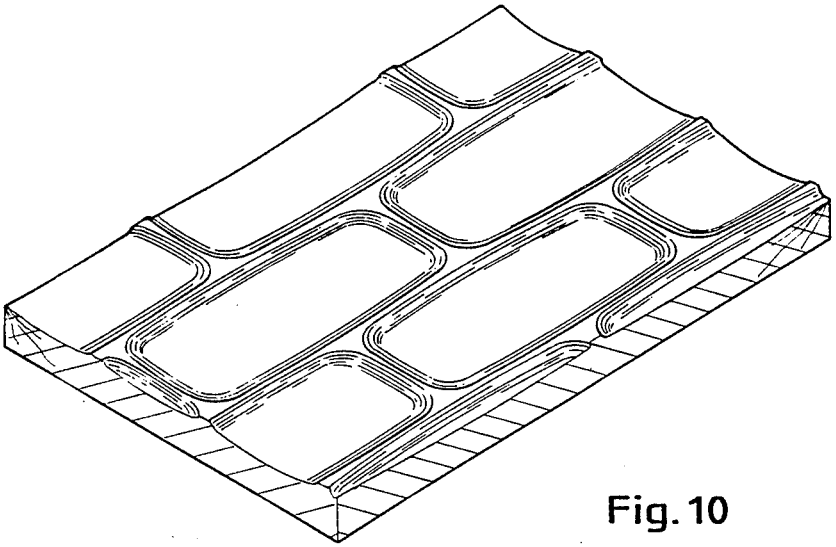
Figure 11:
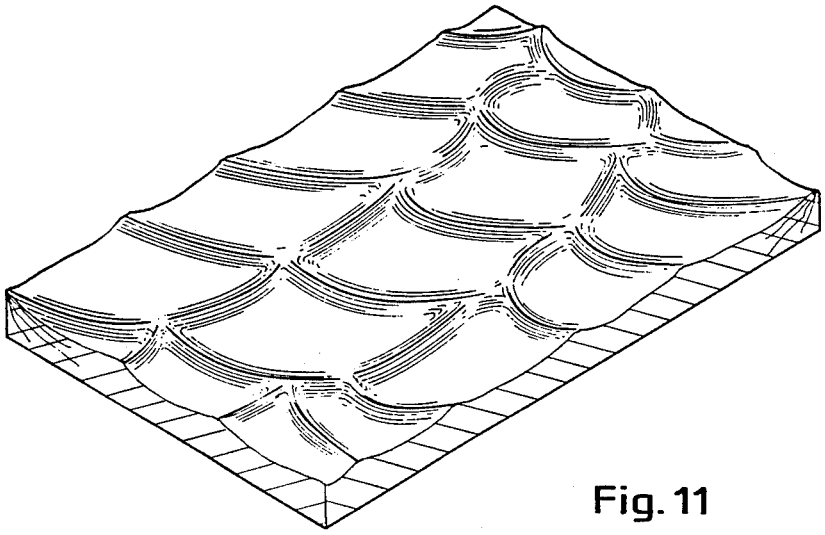

FIG. 8 is a front view of the planing heads, arranged one behind the other, of a apparatus according to a preferred embodiment of the invention;

FIG. 9 is a basic arrangement of a surface texture which can be produced by means of the apparatus according to a preferred embodiment of the invention;

FIG. 10 is an example of a surface texture which can be achieved by means of the apparatus according to a preferred embodiment of the invention;

FIG. 11 is a further example of a surface texture which can be achieved by means of the apparatus according to a preferred embodiment of the invention;

DETAILED DESCRIPTION OF THE PREFERRED EMBODIMENTS

The apparatus according to a preferred embodiment of the invention, as identified in its entirety by the reference numeral 2, comprises a machine frame 4 with an upper mounting plate 6 for supporting the wood boards to be machined (not shown) and vertical legs 8 to which a lower, horizontal carrier plate 10 is secured. Carrier plate 10 carries four threaded spindles 12 in a rectangular configuration mounted free to turn in said carrier plate 10 but which have no freedom of axial movement and which are threaded to a base plate 14 arranged above said carrier plate 10 so that common turning of said threaded spindle 12 enables said horizontal base plate 14 to be lifted and lowered.

To permit common turning of said threaded spindles 12 rim gears 16 are provided on the underside of each threaded spindle and mating with said threaded spindles; said rim gears 16 being driven by a common chain 18 which, in turn, is driven by a sprocket 20. Said sprocket 20 arranged on the underside of said carrier plate 10 is positively connected to a handwheel 22 arranged above said mounting plate 6 by means of which said said sprocket 20 can be driven via a spindle ( not shown) thus permitting height adjustment of said base plate 14. The aforementioned system serves for precise height adjustment of the movable head assembly assy described below.

Above said base plate 14 a guide element identified in its entirety by 24 is provided, the height of which can be varied with respect to said base plate 14. For this purpose, vertical stroke cylinders or guide columns 28 are arranged between said base plate 14 and floor plate 26 of said guide element 24, whereby the height of said guide element 24 can be varied by operating said stroke cylinders 28.

Said guide element 24 features opposed side walls 30 carrying two parallel guide rails 32 running in a horizontal plane, said guide rails running generally at right angles to the direction in which the wood boards for machining are conveyed and providing transverse guidance to a slide element 34. A cylinder/piston assembly 36 is disposed between said guide element 24 and said slide element 34, whereby cylinder 38 is secured to one of the sidewalls 30 of said guide element 24 and piston 40 running parallel to said guide rails 32 is connected at one end to said slide element 34.

Figure 2:
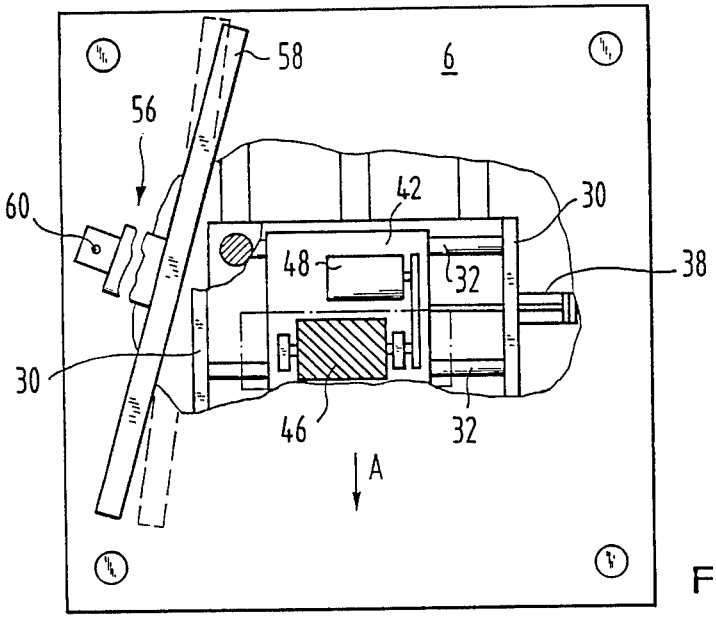
FIG. 2 is a partially section side view of the device shown in FIG. 1.

On a horizontal carrier plate 42 of said slide element 34 two planing heads 44,46 are secured, together with a drive motor 48 for rotating both planing heads. Said planing heads 44,46 are located one behind the other as viewed in the general feed direction A of the wood boards and at a level higher than that of said drive motor 48. Drive belt 50 is used to drive both planing heads 44,46 in common by said drive motor 48. See, for example, FIG. 2.

Figure 4:
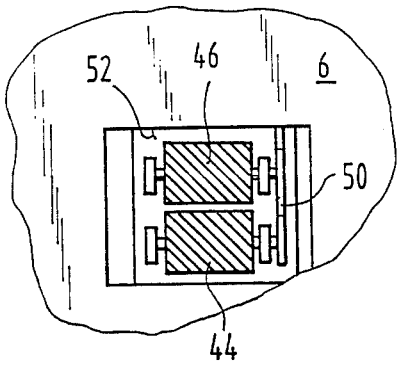
FIG. 4 is a cut-away section of FIG. 3.
Figure 7A:
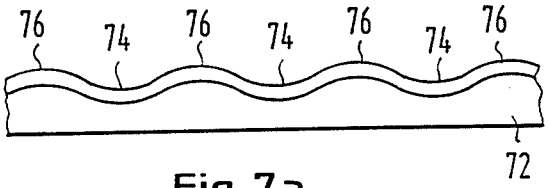
Figure 7B:
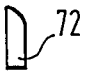

Above said planing heads 44,46, as best seen in FIG. 4, said mounting plate 6 of said machine frame 4 features an opening 52 through which said planing heads 44,46 can be brought into contact with the wood board resting on said mounting plate 6. The width of said opening 52 is sized to also permit side movement of said planing heads 44,46 within the scope of freedom of movement permitted by said guide element 24.

By means of a feed assembly identified in its entirety by reference numeral 54 the wood boards being machined are automatically conveyed at the desired speed over the mounting plate 6, i.e. past its opening 52.

Figure 5:
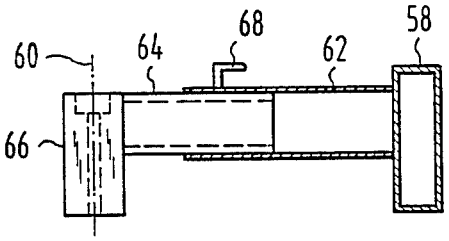
FIG. 5 is a vertical section through the stop as shown in FIG. 3.
Figure 6:
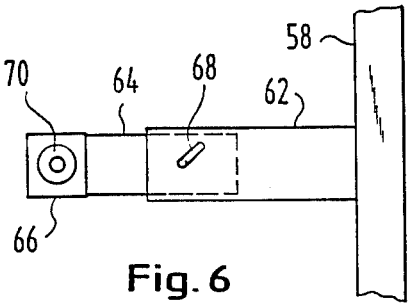
FIG. 6 is a plan view of the stop shown in FIG. 5.

A stop assembly identified in its entirety by reference numeral 56 dictates each direction of movement of the wood board for planing and is direction-adjustable for this purpose. See FIGS. 2 and 5. Said stop assy 56 comprises a stop rail 58 for swivelling about a vertical spindle 60 on said mounting plate 6. Said stop rail 58 carries a hollow section 62 extending in the direction of said spindle 60, a further tubular section 64 being secured in said hollow section 62 and which is, in turn, secured to a clamping block 66 for providing longitudinal sliding movement. In this way the distance of said stop rail 58 from said spindle 60 can be varied and the distance required in each case can be blocked by means of a hand clamp 68 effective between said hollow section 62 and said tubular section 64. Each desired angular setting of said stop rail 58 relative to the general feed direction A can be fixed by means of a clamp screw 70 engaging in said clamping block 66 .

Each desired surface texture of the wood boards is obtained by suitably controlling said stroke cylinders 28 defining the vertical position of said planing heads and by said cylinder/piston assembly 36 defining the horizontal or transverse position of said planing heads. The wood board being machined is fed to said feed assembly 54 via said mounting plate 6; during the continuous thrufeed said planing heads 44,46 are moved horizontally and/or vertically as dictated by a control program. As a result of the horizontal position of the planing heads and of the duration of the the planing cycle reproducible patterns are generated in the surface of the wood board.

Figure 1:
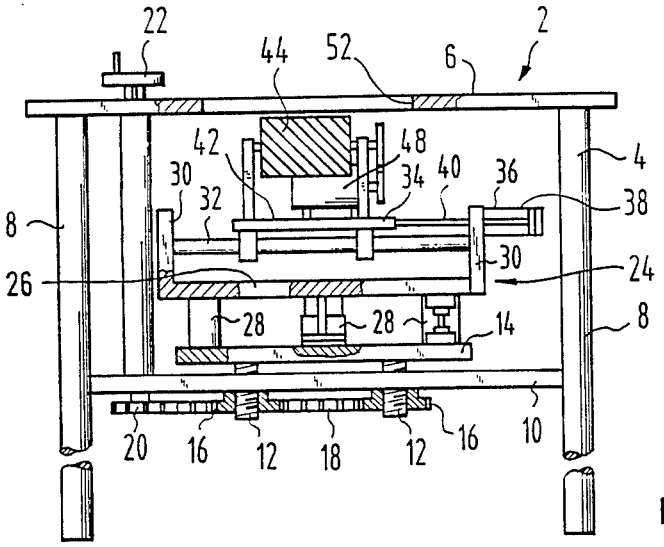
FIG. 1 is a partially sectioned view of the apparatus according to a preferred embodiment of the invention as seen in the feed direction of movement of the wood boards for machining.

For said cylinders 28,38 (see FIG. 1) limit switches are provided to define the limit positions of the planing heads, between which they are cycled in the corresponding direction. The speed at which they are moved in the corresponding direction is controlled in the case of a pneumatic or hydraulic control by flow restrictors or timing valves. By selectively setting the limit switches mounted on said cylinders, and/or varying said restrictors or timing valves, a new texture pattern can be produced each time. Said pneumatic cylinders can be replaced, for instance, by stepper motors and by suitable electronic circuitry.

The cutter inserts of said planing heads 44,46 are shaped in accordance with the desired surface texture configuration. One example of the shape of a cutter insert 72 is illustrated in FIG. *7a* ( front view) and *7b* ( side view). The cutting edge of said cutter insert 72 is wavy-shaped and features a plurality of valleys 74 and peaks 76. Using cutter inserts 72 shaped in this way with cutting structures which are repeated in the transverse direction produces a set of identical scallops in a single machining operation. When the cutting sections of said cutter inserts, as shown in FIG. 8, are arranged offset in opposition preferably in the axial direction of the planing heads in such a way that the peaks of the one cutter insert coincide with the valley of the other cutter insert — as viewed in the projection — offset rows of scallops are planed in the transverse direction as shown in FIG. 9. In a single plane cycle scallops "a" are produced by one planning head and scallops "b" by the other planing head. In the next cycle scallops "a" are produced by the one planing head and scallops "b" by the other planing head, and so on.

Figure 3:
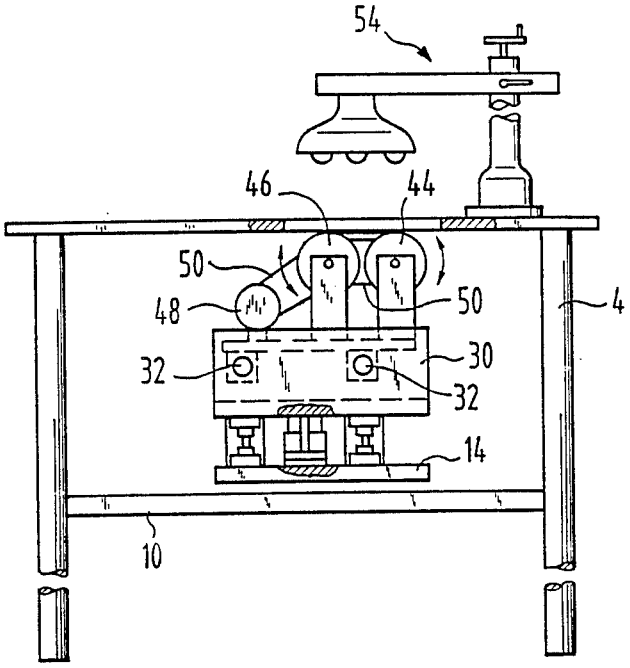
FIG. 3 is a plan view of the device shown in FIG. 1.

FIG. 10 illustrates — merely by way of example — a planed texture produced by the device as the object of the invention. The planed texture as shown in FIG. 11 with slanting edges is produced by setting said stop 58 ( see FIG. 3) at an angle to the general feed direction A, so that the wood boards are guided in a slanting manner past the planing heads in their entirety.

Still other objects and advantages of the present invention will become readily apparent to those skilled in this art from the preceding detailed description, wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive, the invention being defined solely by the claims appended hereto.

What we claim is:

1. Apparatus for machining a selected texture in a machinable surface of a board, comprising:

two machining heads disposed to be separated with respect to each other in a first direction, each machining head having a predetermined machining profile for correspondingly machining said machinable surface of the board;

means for guiding movement of the board relative to said machining heads along said first direction;

means for controllably moving each of said two machining heads toward and away from said machinable surface of the board, whereby said two machining heads cooperatively machine a predetermined texture in accordance with said predetermined profiles and said guided relative motion between said board and said machining heads.

2. Apparatus according to claim 1, further comprising:

means for controllably providing a relative motion between said machining heads and said board in a plane parallel to said board along a second direction oriented at a predetermined angle with respect to said first direction.

3. Apparatus according to claim 2, wherein:

said predetermined angle is a right angle.

4. Apparatus according to claim 1, wherein:

each of said two machining heads has a machining profile comprising cutting-edges counter-disposed to each other.

5. Apparatus according to claim 1, wherein:

said machining heads comprise cutting-edges of wavy-shape with a plurality of peaks and valleys in sequence.

6. Apparatus according to claim 1, further comprising:

machining head mounting means comprising a slide element movable transversely of said first direction on a height-adjustable guide element.

7. Apparatus according to claim 6, wherein:

said slide element and said guide element are moved by cylinder-piston assemblies.

8. Apparatus according to claim 6, wherein:

said machining head mounting means comprises a machine frame, a base frame, a base plate height-adjustably mounted to said machine frame, and a guide element height-adjustably mounted to said base plate.

9. Apparatus according to claim 1, wherein:

said means for moving said two machining heads comprises means for programming a predetermined sequence of selected movements for each of said two machining heads.

10. Apparatus according to claim 1, further comprising:

a board mounting plate having an opening through which said machining heads are brought into contact with the machinable surface of the wood board being machined thereby.

11. Apparatus according to claim 1, further comprising:

means for controllably moving wood boards past said machining heads.

12. Apparatus according to claim 1, wherein:

said means for guiding board movement comprises an adjustable guide stop for the wood boards, to permit varying of the direction of movement of the wood boards relative to the machining heads to adjust a texture of said machined board thereby.

13. Apparatus according to claim 1, wherein:

said machining heads are powered by a common drive motor.

* * * * *